United States Patent [19]

Goodman

[11] 3,995,668

[45] Dec. 7, 1976

[54] NET WEIGHT FILLER

[76] Inventor: James A. Goodman, 9347 Springfield, Evanston, Ill. 62206

[22] Filed: Feb. 6, 1975

[21] Appl. No.: 547,596

[52] U.S. Cl. ..... 141/34; 141/129; 177/55; 177/59; 222/330; 222/478

[51] Int. Cl.[2] ..... B65B 1/14

[58] Field of Search ..... 177/54, 55, 59, 103, 177/104; 141/131–133, 144, 145, 153, 166, 167, 196, 83, 238, 100, 125, 191, 34, 129; 222/330, 478, 77, 196

[56] References Cited

UNITED STATES PATENTS

| | | | |
|---|---|---|---|
| 3,477,530 | 11/1969 | Garnett | 177/55 |
| 3,550,650 | 12/1970 | Yamashita | 177/54 |

*Primary Examiner*—Houston S. Bell, Jr.
*Attorney, Agent, or Firm*—Irving Faber

[57] ABSTRACT

This invention relates to a new and useful apparatus that incorporates the precision and accuracy of net weight fillers with the speed and economy of volumetric fillers. The invention comprises means for receiving a flowable product, said means being connected to a scale. When the product within the receiving means reaches a predetermined weight, it is deposited into a cavity having a plurality of equal chambers and is evenly distributed therein by rotary motion means. A plurality of containers are positioned relative to the cavity to receive the product from the chambers.

37 Claims, 22 Drawing Figures

FIG. 6
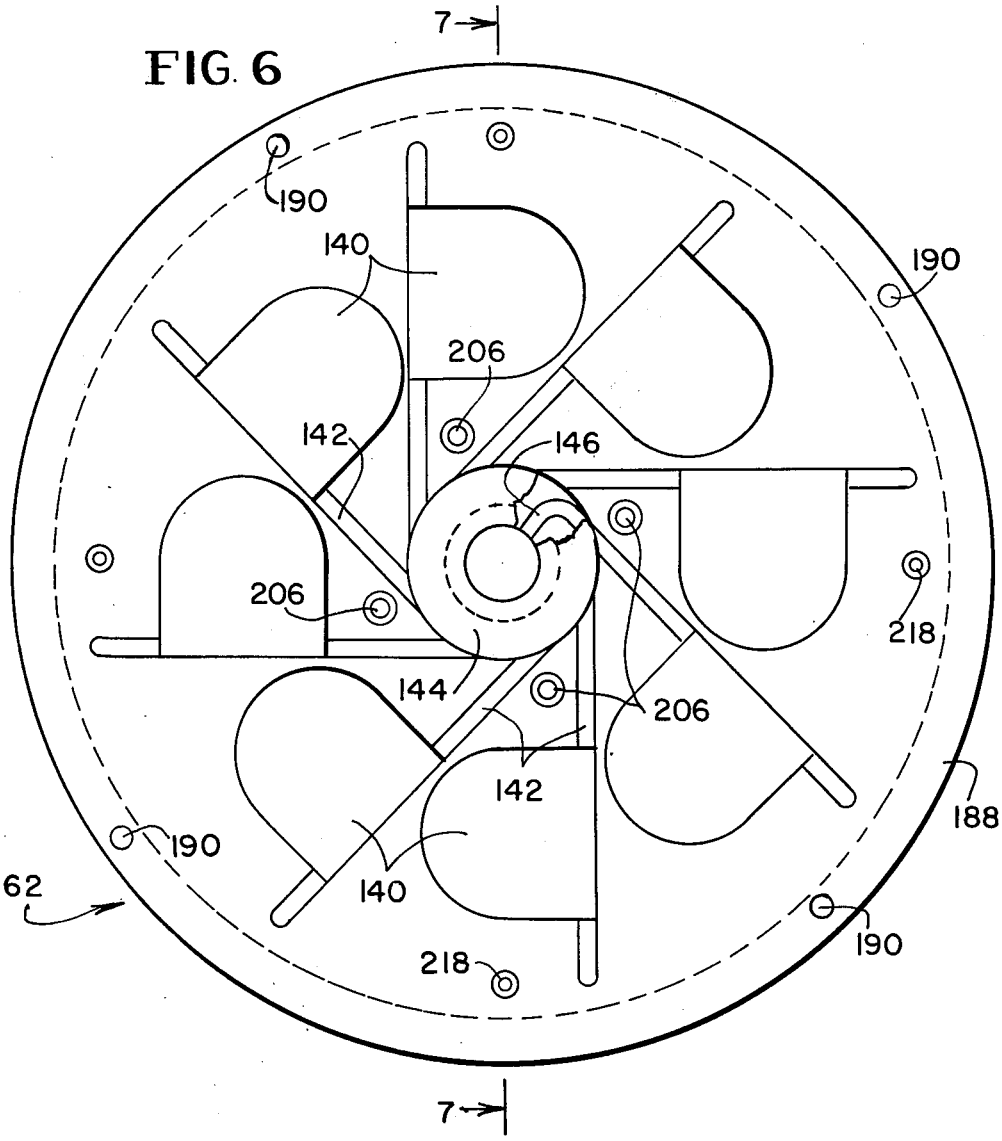
FIG. 7
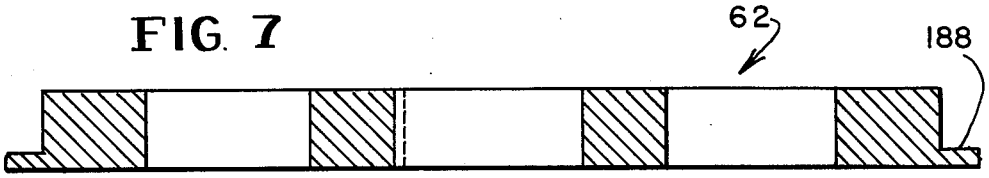
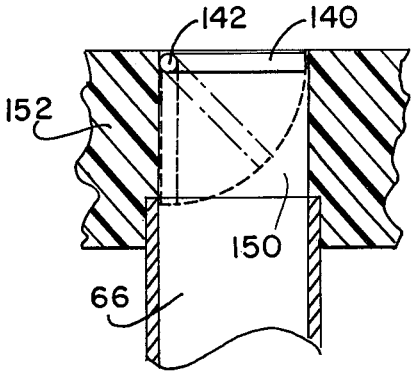
FIG. 8b

FIG. 12
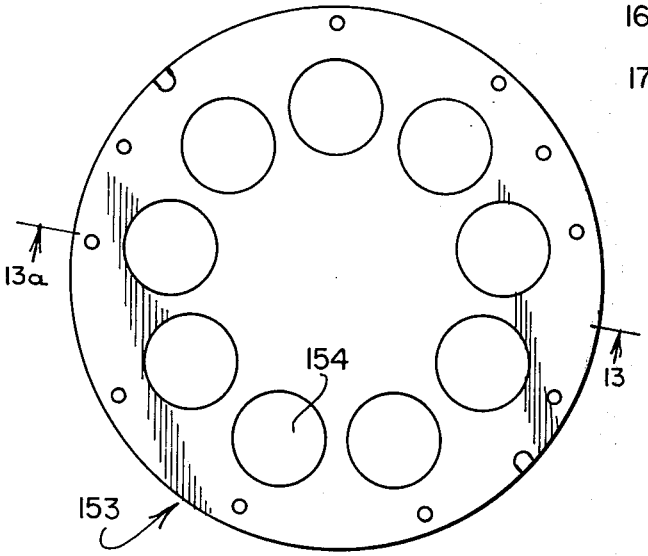
FIG. 15
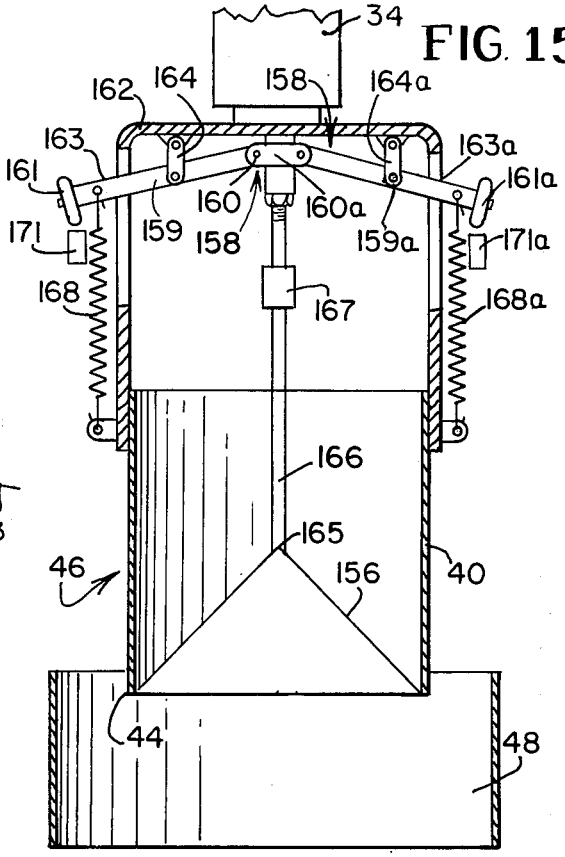
FIG. 13
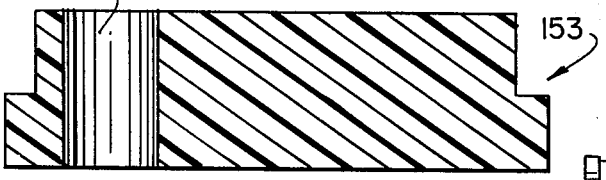
FIG. 11
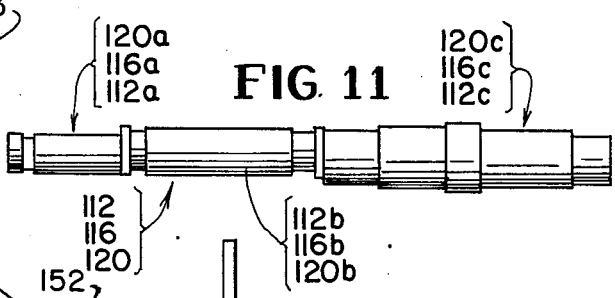
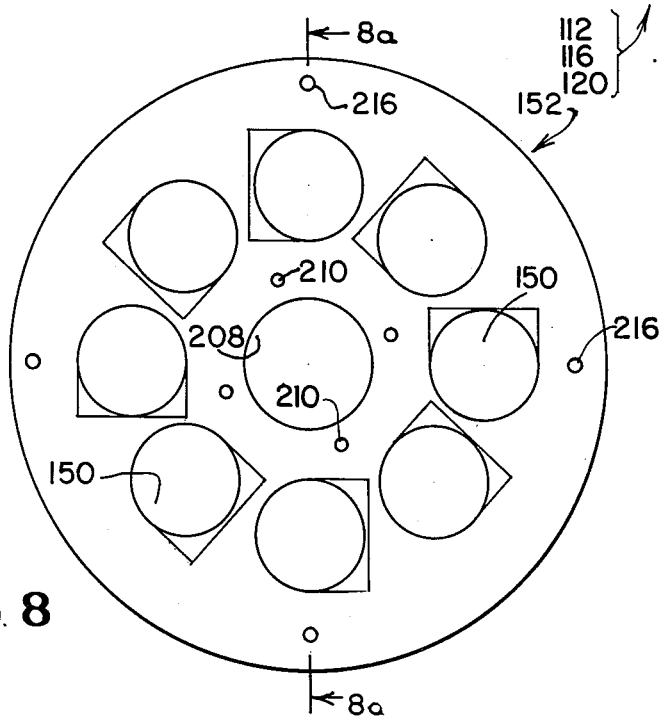
FIG. 8
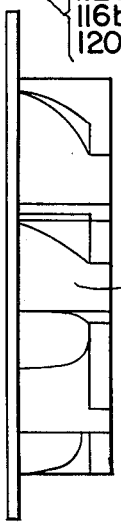
FIG. 8a

NET WEIGHT FILLER

BACKGROUND OF THE INVENTION

This invention relates to a new and useful apparatus that combines the accuracy and precision of a net weight filler with the speed and economy of a volumetric filler. Heretofore, net weight fillers consisted of means for filling a hopper or other receiving means with a product to a preset weight at which time the product was discharged into a waiting container. It is well known that filling of containers with product by weight is more accurate than filling by volume. The basic reason that filling by weight is more accurate than filling by volume is that a change in density of the product is directly reflected in the weight of the product; this is not so when filling by volume.

The filling of containers by the net weight process, though basically very accurate, is much slower than the volumetric process. The volumetric process is less efficient in that it does not compensate for density change of the product and when filling there is generally an overflow that is not recoverable.

Heretofore, as far as I know, no one has combined the efficiency and accuracy of the net weight filler with the speed and economy of a volumetric filler for simultaneously filling a plurality of containers.

In the food as well as other industries it is encumbent upon a manufacturer to accurately weigh the contents which he packages for public use. If the package is underweight, he can easily incur the wrath of local and/or state and/or federal authorities under various consumer fraud acts. If the manufacturer fills his package with an excess of material, he is losing money in that he is giving away product. The smaller the weight the more difficult it is to meet packaging standards. This is true because a more delicate scale is required as the weight diminishes. Also, when the material is not liquid or granular, but of a solid shape such as peanuts and the like, it is difficult to accurately premeasure a small net weight quantity in that an individual particle of product becomes a greater percentage of net weight. However, if a plurality of packages or containers are to be filled simultaneously, then the weight of the product in the plurality of containers does not require a scale as delicate as would be if one container was to be filled.

My invention as disclosed hereinafter enables the simultaneous filling of a plurality of containers by net weight. My apparatus combines the accuracy of the net weight filler with the speed and economy of the volumetric filler. It further enables the simultaneous filling of a plurality of containers wherein the net weight of the contents in each container is a fraction of an ounce without the necessity of using delicate and expensive scales.

The present invention is an innovation in the art of weighing product for simultaneous filling into a plurality of containers.

The present invention is the first to combine in a simple apparatus the accuracy of the net weight fillers with the speed and efficiency of the volumetric process.

SUMMARY OF INVENTION

The present invention relates to a new and useful apparatus that combines the accuracy of the net weight fillers with the speed and economy of the volumetric fillers and in particular to an apparatus that will accurately premeasure by weight and simultaneously fill a plurality of containers or packages. The invention can be used for filling containers accurately and economically having products therein of a fraction of an ounce to several pounds. The invention incorporates a hopper for distributing product to a weigh bucket via conveyor means. The weigh bucket is coupled to a scale; the scale having means for accurately determining a preset weight and then releasing the product within the weigh bucket into a cavity. The cavity has a plurality of equal chambers for receiving the product from the weigh bucket. Once the product is deposited into the cavity, rotary motion means coupled to the cavity create centrifugal forces within each chamber of the cavity enabling the total product deposited within the cavity to be evenly distributed in each chamber. It is the rotary motion means that enables an equal quantity, by weight, of product to be distributed in each chamber of the cavity.

The contents of each chamber is transferred to containers by means of discharge tubes coupled to each of said chambers.

It is the primary object of my invention to provide an apparatus for accurately measuring a predetermined net weight for distribution into a plurality of containers.

Another object of my invention is to combine is to combine the accuracy of a net weight filler with the economy of a volumetric filler into a single efficient, accurate and economical apparatus.

It is a further object of my invention to provide means for evenly distributing, by weight, a quantity of product equally into a plurality of packages.

It is still a further object of my invention to provide an apparatus having rotary motion means that will enable product to be evenly distributed, by weight, into a plurality of chambers.

IN THE DRAWINGS

FIG. 6 is a plan view of the chamber relese means embodied by this invention.

FIG. 7 is a cross sectional view along the line 7—7 of the chamber release means embodied by this invention.

FIG. 8 is a plan view of the transitional section embodied by this invention.

FIG. **8*a* is a side view of the transitional section along the line 8*a* — 8*a* of FIG. 8.**

FIG. **8*b*** is an elevational cross section of the transitional section and discharge tube embodied by this invention.

Figure 9:
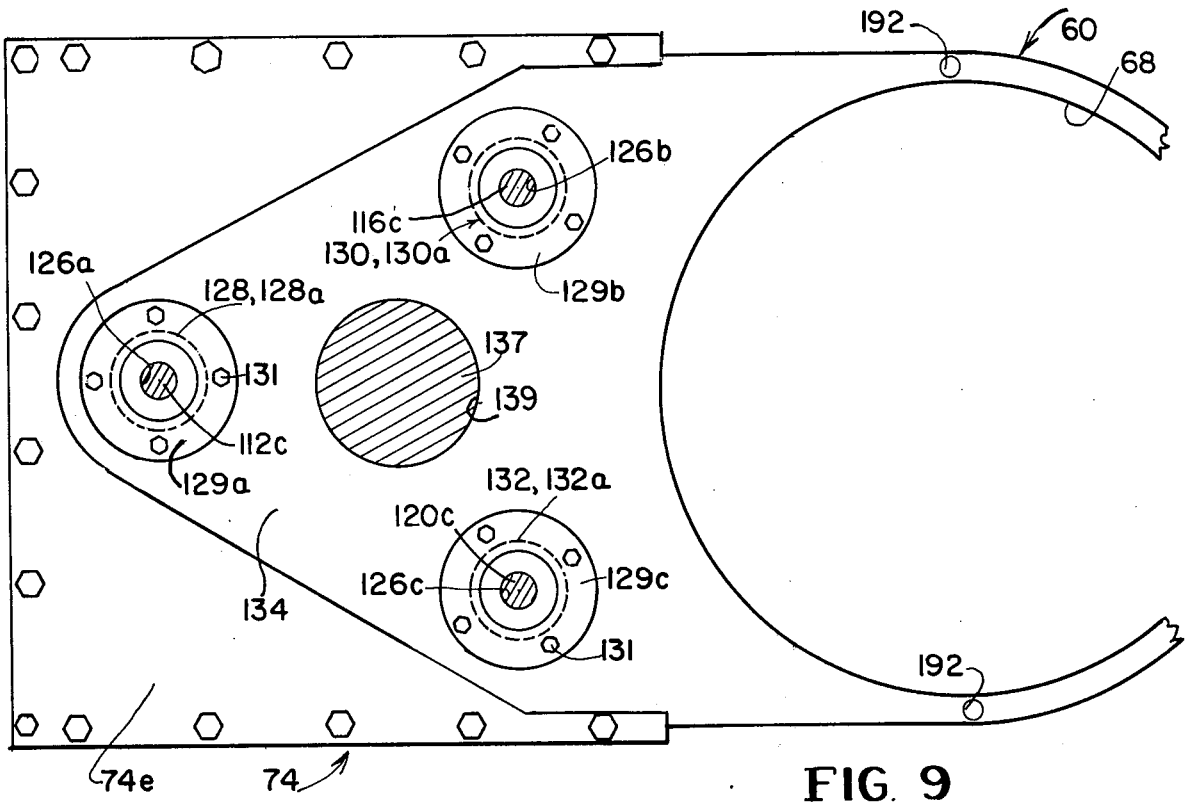

FIG. 9 is a top view of the rotary motion plate and gear box assembly embodied by this invention.

Figure 5:
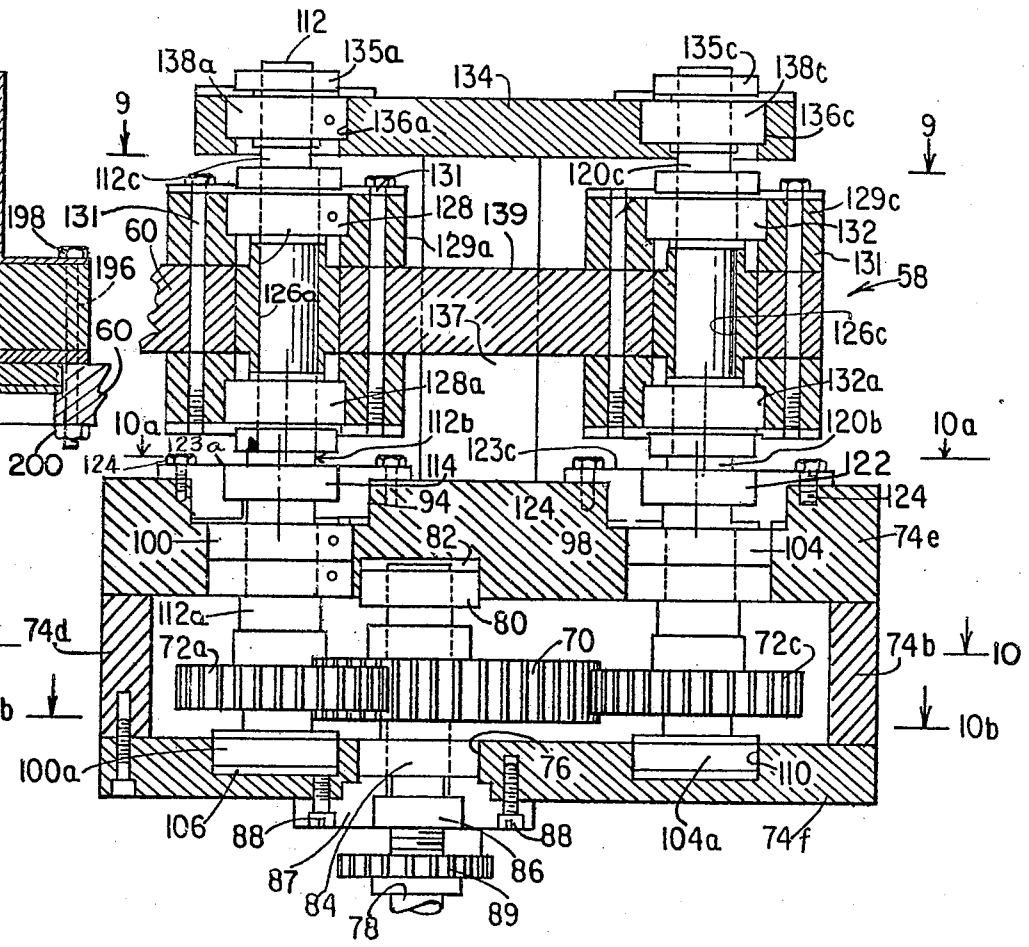
FIG. 5 is a side elevational cross sectional view of the rotary motions means embodied by this invention.
Figure 10:
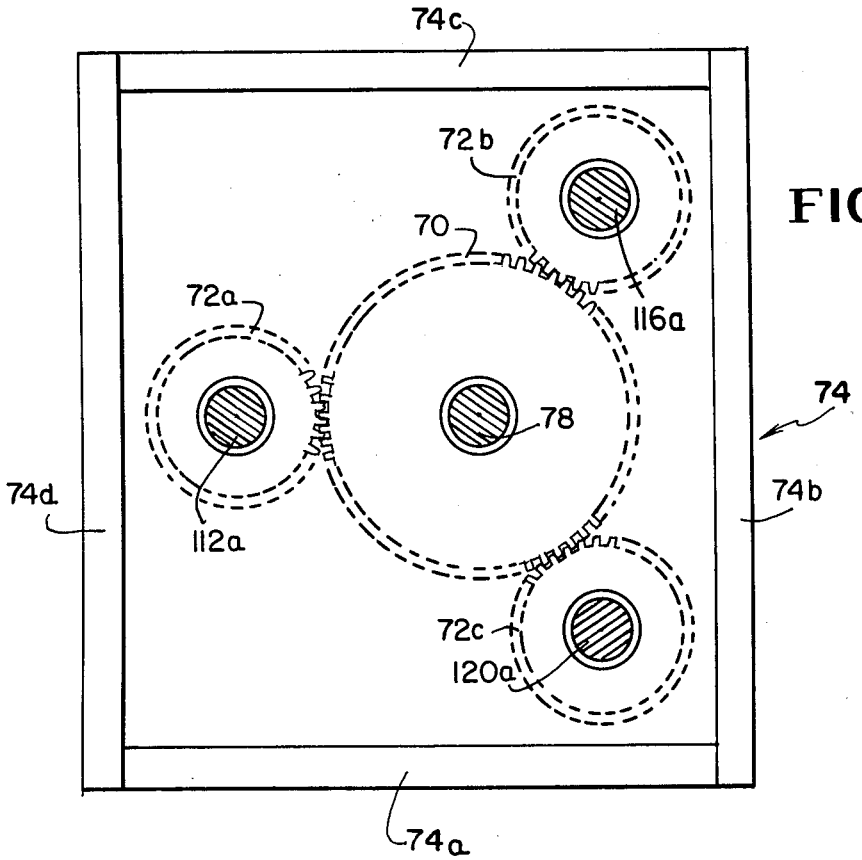

FIG. 10 is a plan view illustrating the gears incorporated in the rotary motion means embodied by this invention taken along line 10 — 10 of FIG. 5.

FIG. **10*a* is a plan view of the top side of the gear box embodied by this invention taken along line 10*a* — 10*a* of FIG. 5.**

FIG. **10*b* is a plan view of the bottom side of the gear box embodied by this invention taken along line 10*b* —10*b* of FIG. 5.**

FIG. 11 is a longitudinal view of an eccentric shaft embodied by this invention.

FIG. 12 is a top plan view of the extender section embodied by this invention.

FIG. 13 is a front elevational cross sectional view of extender section embodied by this invention taken along line 13 — 13.

Figure 14:
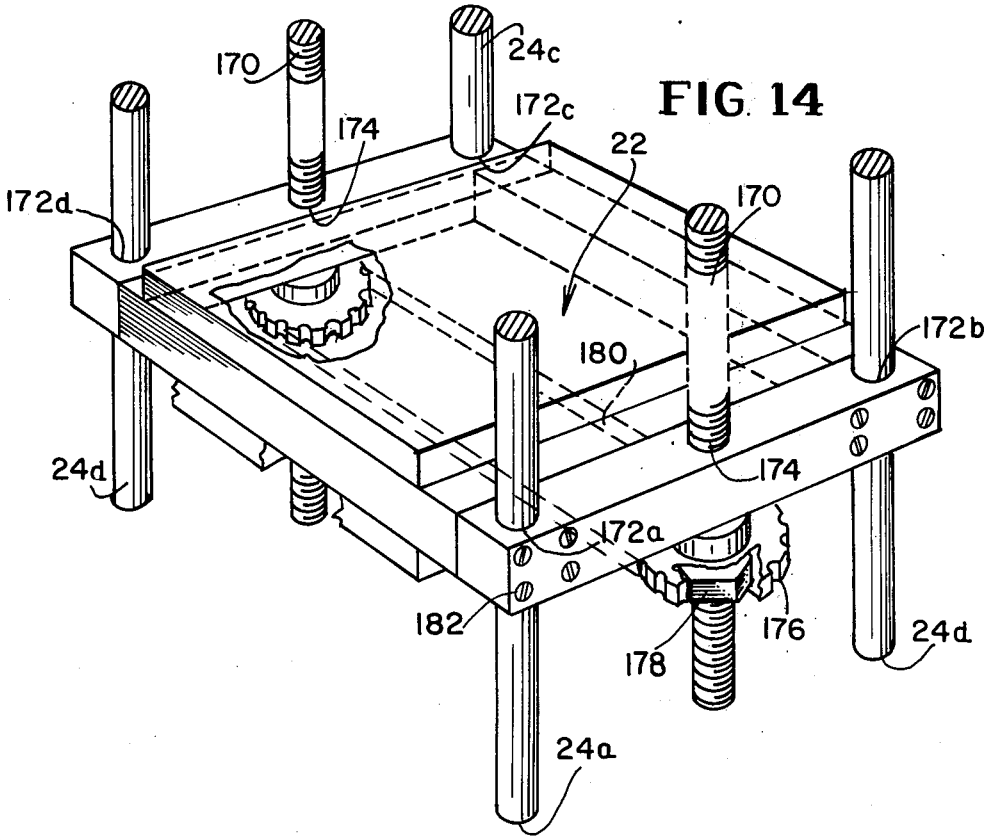

FIG. 14 is a break-away perspective view of the feeder base embodied by this invention.

FIG. 15 is an elevational view of the weight bucket release means incorporated by this invention.

Figure 16:
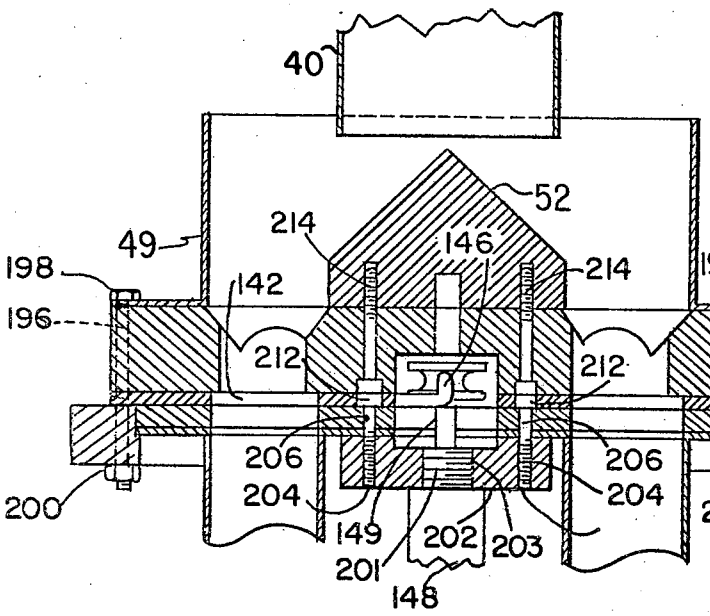

FIG. 16 is an elevational cross sectional view of the cavity, the chamber release means, and the transitional section embodied by this invention.

Figure 17:
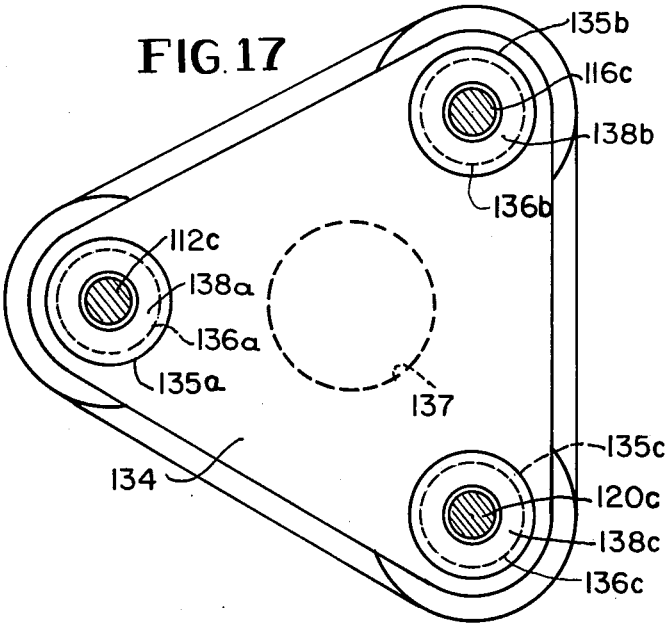

FIG. 17 is a top plan view of the shaft support plate embodied by this invention.

Figure 18:
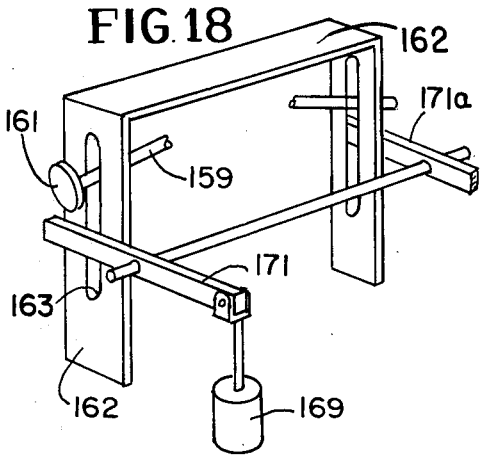

FIG. 18 is a break away perspective view of the chamber release means support bracket embodied by this invention.

DESCRIPTION OF PREFERRED EMBODIMENT

Figure 1:
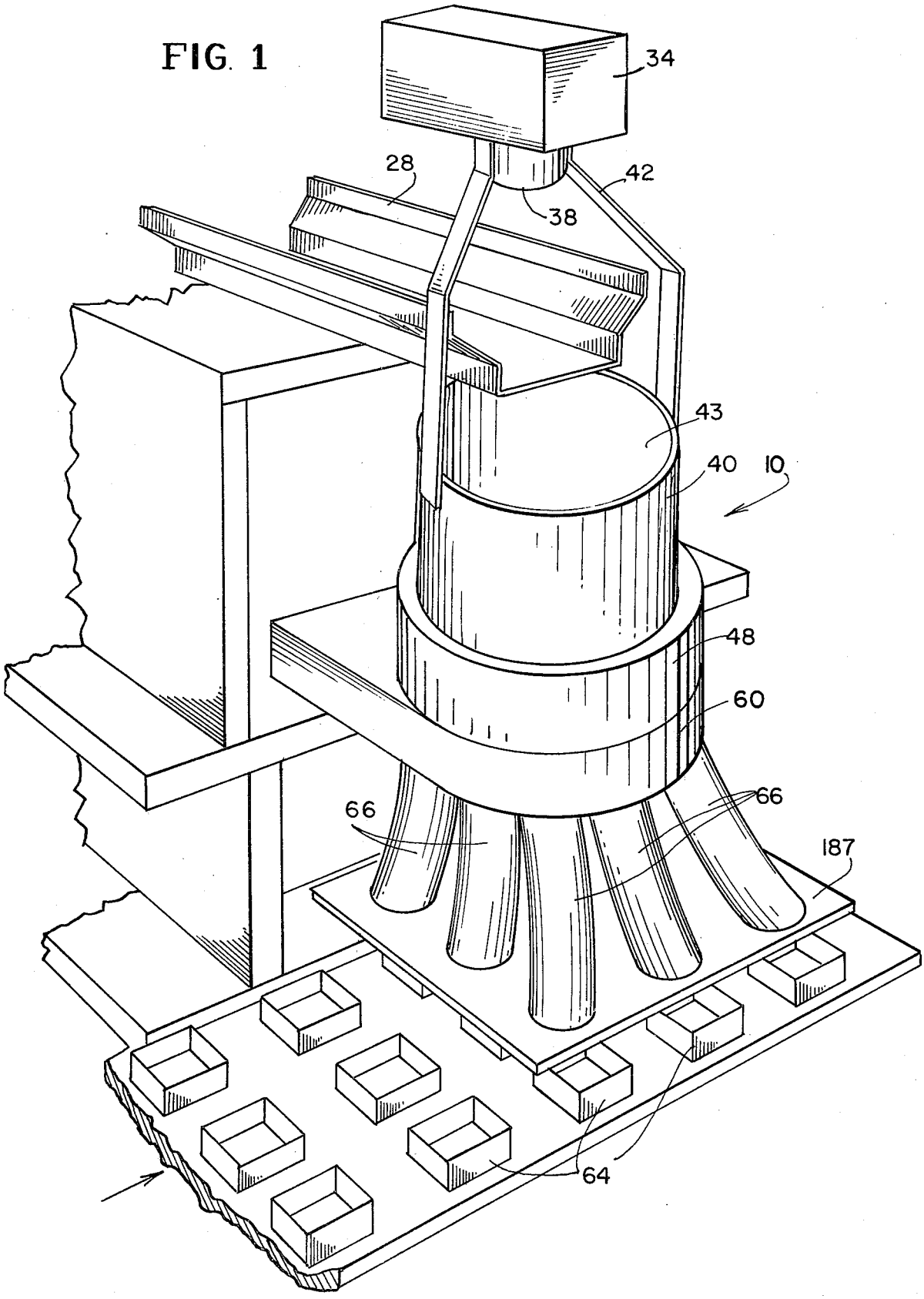
FIG. 1 illustrates in perspective a break away view of the apparatus embodied by this invention.
Figure 2:
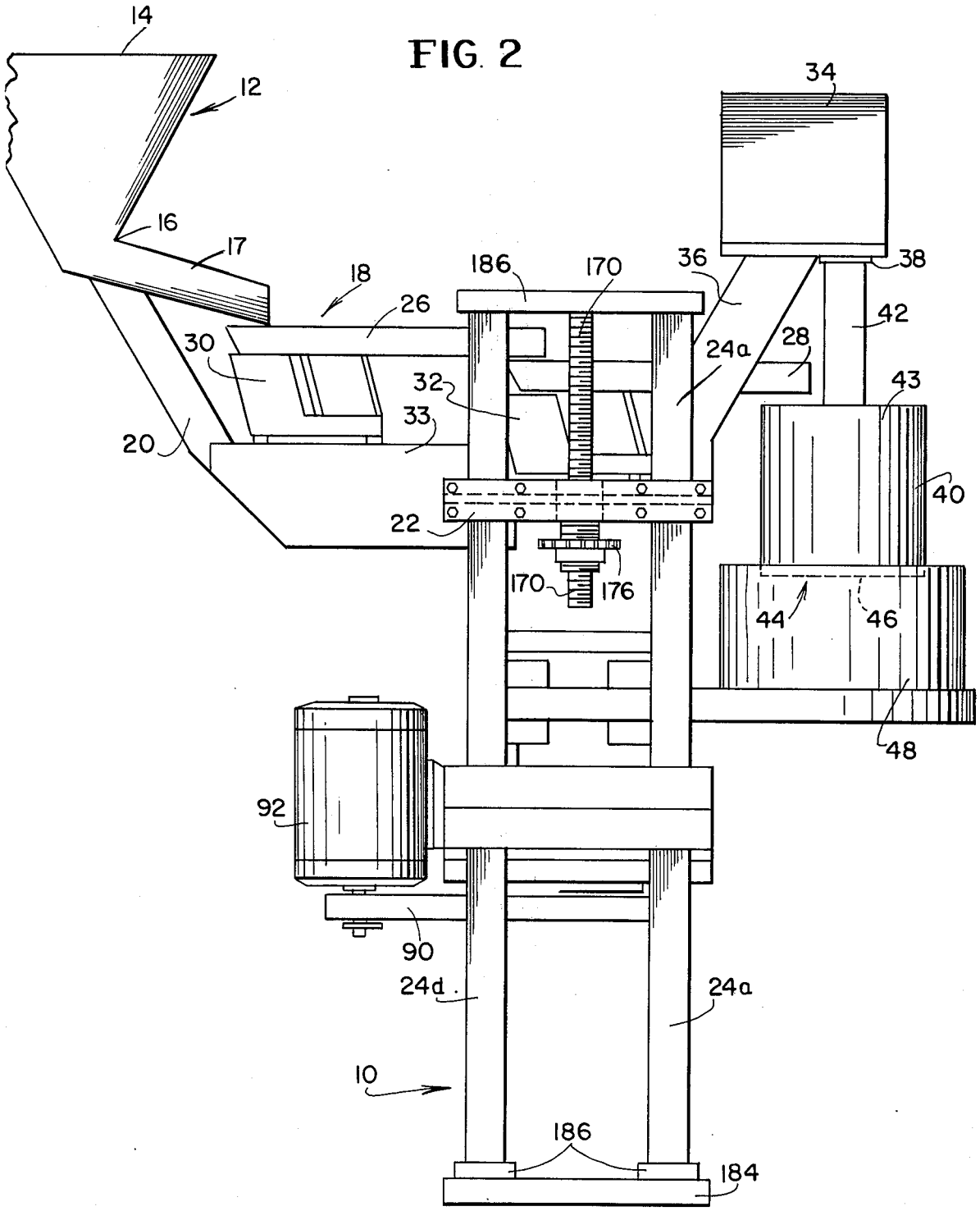
FIG. 2 illustrates a side elevational view of the apparatus embodied by this invention.

FIG. 1 illustrates, in perspective, a break away view of the apparatus 10 embodied by this invention. As illustrated in FIG. 2 a filler hopper 12 has its upper end 14 open for receiving a product. The product, not shown, may be of a granular of powdered consistency or of a solid shape such as a peanut and the like. The product or material is placed into the hopper 12 by means well known in the art, said means not being illustrated and the flow of product being of a continuous or periodic nature. The hopper 12 has a lower end 16 having an integral chute or passageway 17 that is positioned directly over or adjacent to a conveyor means 18. The lower end of the hopper 16 is substantially smaller than the upper end 14 for controlling the flow of product to the conveyor means 18. The hopper is basically the shape of a funnel, however, any shape may be used for the hopper 12. It is understood that the lower end 16 of the hopper 12 does not have to be smaller than the upper end 14, although it is preferred. It is also possible to place the lower end of the hopper directly over the conveyor means 18 eliminating the chute or passageway 17. The hopper 12 may be structurally coupled to the apparatus 10 as illustrated in FIG. 2 by a hopper support structure 20 or it may have its own supporting structure; such supporting structure not being illustrated. The hopper support structure 20 is preferably of steel stock having sufficient strength to support the hopper and its contents and is coupled to a feeder base member 22. The feeder base member 22 is coupled to vertical frame columns 24*a*, 24*b*, 24*c*, and 24*d* of the structure 10. The hopper support structure 20 may be of a material or composition other than steel without departing from the spirit and scope of the invention; however, it must possess sufficient structural strength to support the hopper 12 and the product contained therein. Whether the hopper 12 is structurally supported by the apparatus 10 or by its own supporting structure, the lower end 16 of the hopper must be positioned relative to the conveyor means 18 to enable a flow of product from the hopper 12 to the conveyor means 18.

The conveyor means 18 comprises a rear product feeder pan 26 and a front product feeder pan 28. The rear product feeder pan 26 and the front feeder pan 28 are positioned adjacent one another and are in a relationship so as to enable product to be efficiently transferred from the rear product feeder 26 to the front product feeder 28. The positions illustrated, in FIG. 2, are such that the product is transferred from the rear product feeder pan 26 to the front product feeder pan 28 by means of gravity. In FIG. 2, the chute or passageway 17 of the hopper 12 is positioned adjacent to and above the rear feeder pan 26.

The product is transferred along the rear product feeder pan 26 and the front product feeder pan 28 by means of electromagnetic feeders 30 and 32 that are coupled to the feeder pans 26 and 28 respectively. Electromagnetic feeders are well known in the art and are readily available in the market place. The electromagnetic feeders 30 and 32 enable the product to be conveyed along their respective feeder pans 26 and 28 by means of a vibratory motion; said vibratory motion being an inherent characteristic of said feeders. The electromagnetic feeders 30 and 32 are coupled to their associated feeder pans or troughs 26 and 28 in a manner well known in the art enabling the vibratory motion to be imparted to their respective feeder pans. The electromagnetic feeder 30 and and its associated feeder pan 26 are coupled to the apparatus 10 by means of horizontal feeder support structure 33; said support structure being coupled to the feeder base member 22 by means of welding or other means well known in the art. The hopper support structure 20 is welded to the feeder support structure 33 or is otherwise attached thereto by other means well known in the art. The electromagnetic feeder 32 and its associated feeder pan 28 are coupled directly to the feeder base 22 by means well known in the art. The feeders 30 and 32 are electrically operated and controlled. The power and control circuitry for the feeders 30 and 32 is not illustrated; said circuitry being well known in the art. It is understood that less than, or more than, the two electromagnetic feeders may be used in lieu of the two illustrated in FIG. 2 without departing from the spirit and scope of the invention.

There are many other means well known in the art for conveying product from one place to another; one other such means, not illustrated, being a conveyor belt feeder or a screw type feeder. However, any of the conveying means known in the art can be used without deviating from the spirit and scope of the invention. I have chosen to use electromagnetic feeders because I believe they are the most effective means for conveying the widest range of products. Another reason that I have chosen to use electromagnetic feeders as conveyor means is their instantaneous response to an appropriate electrical signal to stop and start cycles.

Weigh measuring means 34 are coupled to the feeder base member 22 by means of a weigh cell support bracket 36; said weigh measuring means being a weigh cell. The weigh cell 34 is one of the many readily available in the market. One end of the weigh cell support structure 36 is welded to the feeder base 22 or secured thereto by other means well known in the art. The other end of the weigh cell support structure 36 is coupled to the weigh cell 34 by means well known in the art.

The weigh cell 34 has an adapter 38 coupled to its internal mechanism not illustrated. A weigh bucket 40 is coupled to the adapter 38 by means of a weigh bucket support member 42. The weigh bucket 40 is of a cylindrical configuration having an open top end 43 and a bottom end 44. The bottom end 44 of the bucket 40 is comprised of bucket release means 46 that enables the contents within said bucket to be discharged upon a given signal. It is understood that the bucket 40 may be of a configuration other than cylindrical without departing from the spirit and scope of this invention.

The weigh cell 34 and its associated classifier controller, not shown, that I have chosen enables one to preset a certain weight, by means of establishing a reference d-c voltage. The classifier controller enables one to set a d-c voltage to represent a certain weight; this being the referenced weight/voltage. The weigh cell 34 has contained therein a linear transducer coupled to its internal mechanism, not shown, which creates a d-c voltage linearly proportional to the weight of the product within the bucket 40. The internal mechanism of the weigh cell 34 is deflected by the addition of product weight into the weigh bucket 40. The d-c voltage generated by the linear transducer as product is added to the weigh bucket 40 is transmitted to the classifier controller and compared with the referenced weight/voltage. An electrical control signal is generated upon the linear transducer generating a d-c voltage equal to the referenced weight/voltage; said signal stopping the feeder 30 and 32 and hence the flow of product into the bucket 40. There are many other electrical and mechanical means available for use as a weighing means and such other means can be readily used without departing from the spirit and scope of this invention. A prime factor in determining what type of weigh cell to use would be the total weight desired to be measured. There are many weigh cells available that enable a variable weight to be compared against a fixed weight and upon equalization of the variable to the fixed weight an electrical and/or mechanical signal is generated.

When the referenced weight/voltage has been reached in the bucket 40 and the electromagnetic feeders stopped the weigh bucket release means 46 is activated releasing the product within the bucket into a cavity 48. The electrical control circuitry between the weigh cell 34 and its associated classifier controller, the electromagnetic feeders 30 and 32, and the weigh bucket release means 46 is basic control circuitry and is well known in the art. There is a time delay in the electrical control circuitry that enables the bucket release means 46 to close or return to its normal position prior to the electromagnetic feeders 30 and 32 being activated and the cycle for filling the bucket 40 with product and discharging it into the cavity 48 starts once again.

Figure 3:
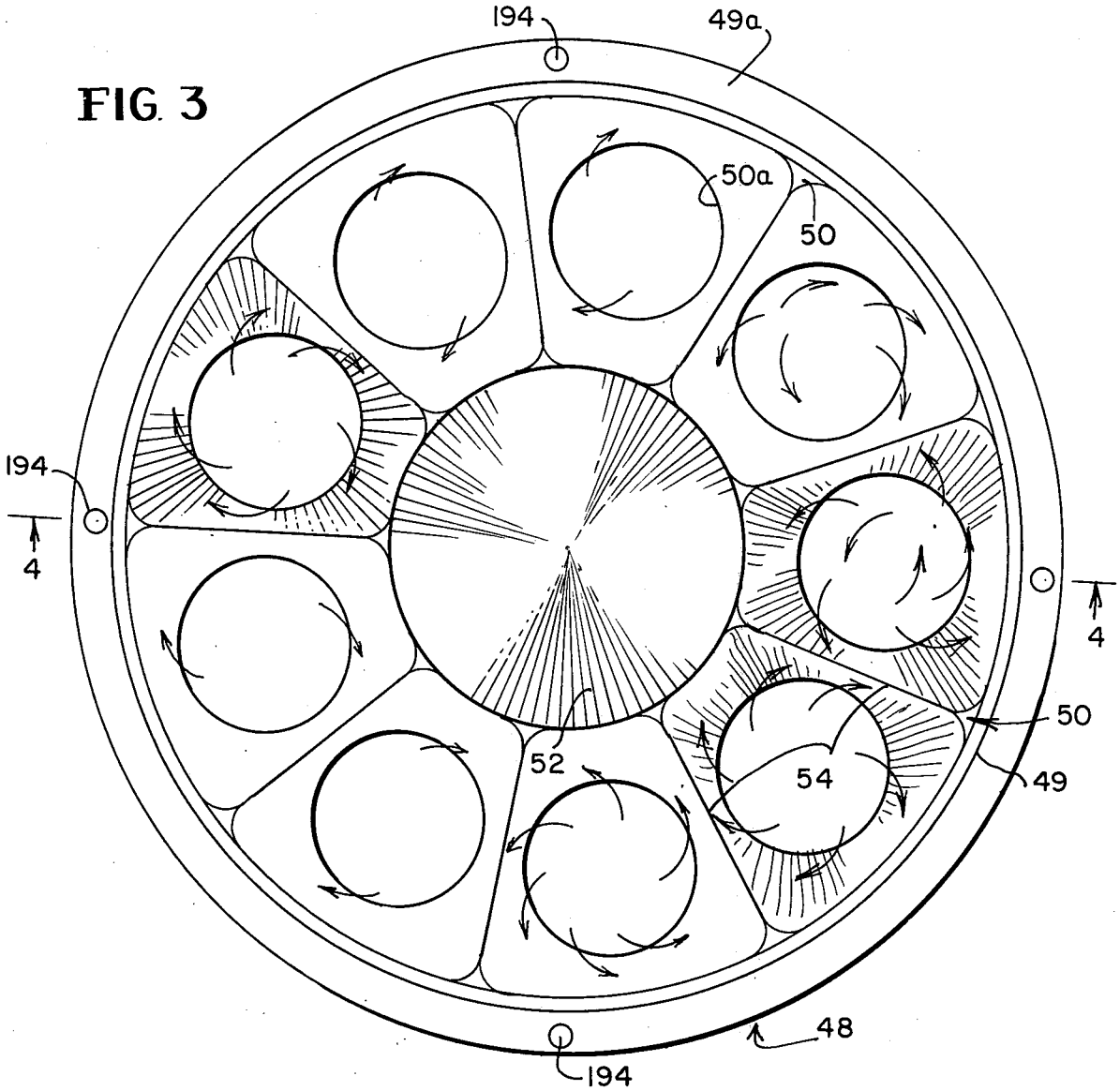
FIG. 3 is a top view of the cavity embodied by this invention.
Figure 4:
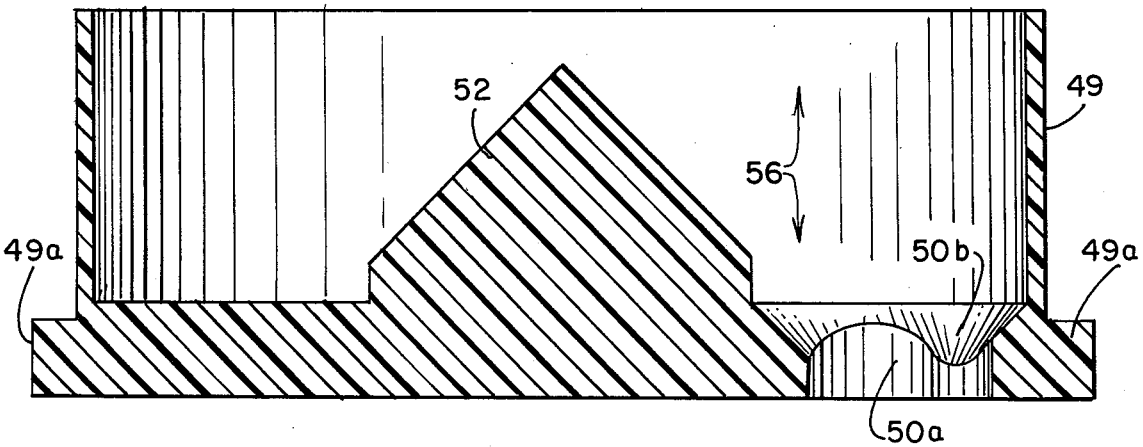
FIG. 4 is a cross sectional view of the cavity illustrated in FIG. 3 taken along line 4—4.

The cavity 48, illustrated in FIGS. 3 and 4, is of a circular configuration having a circumferential outer wall 49 integral with a circumferential flange element 49*a*. The cavity 48 is divided into a plurality of equal chambers 50, nine being illustrated. It is understood that the cavity 48 can be of any geometric configuration and may be divided into any number of chambers without departing from the spirit and scope of the invention. The chambers 50 are circumferentially positioned about the cavity 48; said chambers having a lower section 50*a* and an upper section 50*b*. A cone element 52 is centrally positioned within the cavity 48. The lower section 50*a* of the chamber is of a cylindrical configuration while the upper section 50*b* is of an irregular geometric configuration. The upper section 50*b* of the chamber 50 is designed so as to extend the circumference of the lower portion 50*a* to the cone element 52 and the wall 49. A plurality of radial sides 54 extend between the cone piece 52 and the outer wall 49 of the cavity 48; said radial sides equally separating the plurality of chambers 50. A head space 56 is defined in the area above the combination of the lower section 50*a* and upper section 50*b* of the chamber 50 between the outer wall 49 and the cone element 52. It is understood that many geometrical configurations may be used for chamber 50 and/or its lower section 50*a* and upper section 50*b* without departing from the spirit and scope of the invention. The cavity 48 is directly coupled to rotary motion means 58 by rotary plate 60, said rotary motion means being illustrated in FIG. 5.

Chamber release 62 are positioned adjacent to and coupled below the cavity 48 and are illustrated in FIG. 6. The chamber release means 62, illustrated in FIG. 6, enables the product in each chamber 50 to be discharged into containers 64 via discharge tubes 66.

The rotary motion plate 60 is illustrated in FIG. 9 and is comprised of aluminum stock having an aperture 68 adjacent one end thereof that is of the same inner diameter as is the outer diameter of the cavity wall 49 and the chamber release means 62. The cavity 48, the chamber release means 62, and the aperture 68 are positioned coaxial to one another. The other end of the rotary motion plate 60 is coupled to the rotary motion means 58; said rotary motion means 58 being illustrated in FIG. 5.

The rotary motion means 58 are comprised of a sun gear 70 having three planetary gears 72a, 72b, 72c coupled thereto as illustrated in FIG. 10. It is understood that more or less than three planetary gears may be used without deviating from the spirit and scope of this invention; however, I have found that I obtain the best results by using three planetary gears. The sun gear 70 and its associated planetary gears 72*a*, 72*b*, and 72*c* are positioned within a gear housing or box 74 as illustrated in FIG. 10. The gear box 74 is of an oil tight construction well known in the art for containing oil therein. The gear box 74 is of a rectangular configuration having sides 74*a*, 74*b*, 74*c*, and 74*d* and a top and bottom side 74*e* and 74*f* of the gear box 74 enabling the insertion therein of a drive shaft 78 as illustrated in FIG. 10*b*. The upper end of the shaft 78 is positioned into a bearing 80. The bearing 80 is positioned in a bearing recess 82 in the top wall 74*e* of the gear box 74. A bearing 84 is positioned adjacent the aperture 76, enabling the placing of the shaft 78 therethrough. An oil seal 86 is positioned adjacent to and coaxial with the bearing 84 sealing the aperture 76. The oil seal 86 is press fit into a bearing retainer 87 which in turn is secured by means of bolts 88 to the gear box 74. The sun gear 70 is coupled to the drive shaft 78 between the bearings 80 and 84 by means well known in the art. The outer end of the drive shaft 78 has coupled thereto drive means 89 suitable for attaching thereto a drive belt 90 which in turn transmits power for a motor 92 to the drive shaft 78 via the drive belt 90.

Figure 10A:
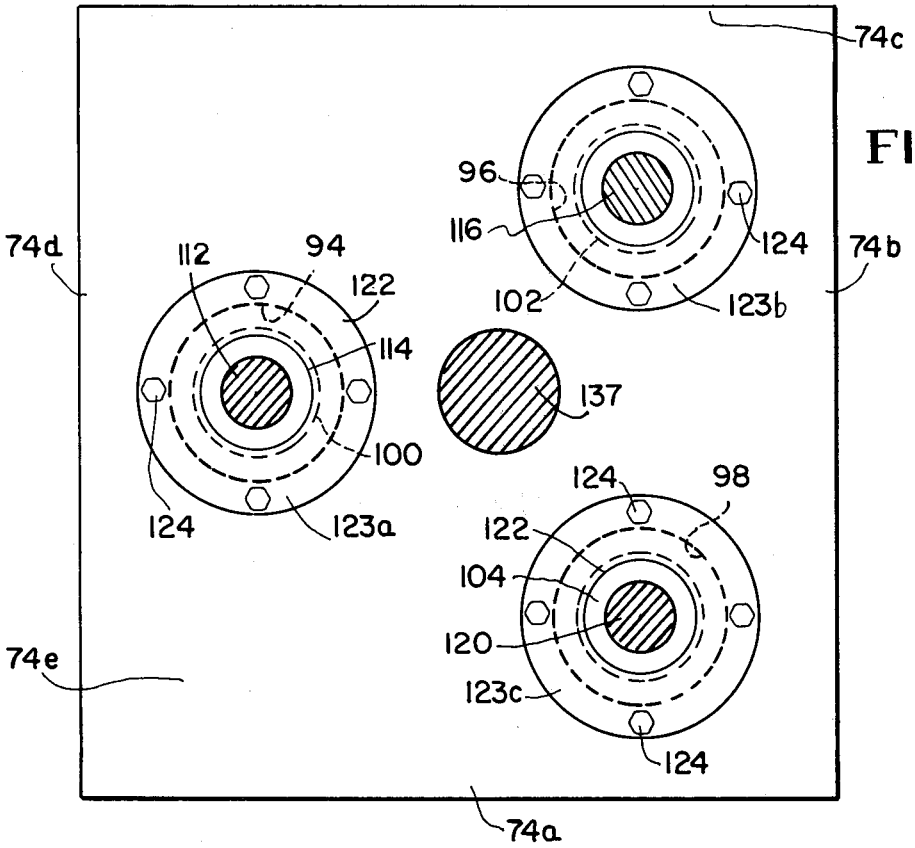
Figure 10B:
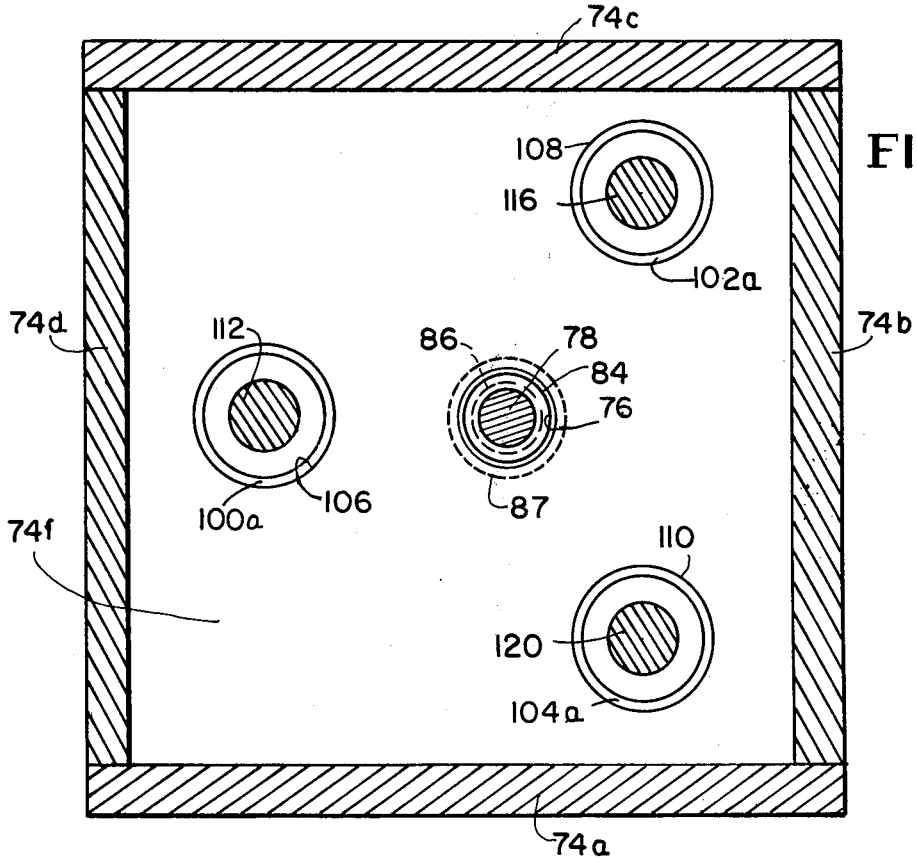

There are three apertures 94, 96, and 98 positioned equidistant and equiangular from each other in top side 74*e* of the gear box 74 as illustrated in FIG. 10*a*. The apertures 94, 96, and 98 are of a diameter sufficient to enable the press fit therein of double bearings 100, 102, and 104 respectively. Opposite the apertures 94, 96, and 98 in bottom wall 74*f* of the gear box 74 are bearing recesses 106, 108, and 110 respectively. The diameter of the bearing recesses 106, 108 and 110 is suitable for positioning therein bearings 100*a*, 102*a*, and 104*a*. The bearings 100 and 100*a* are coaxial. An eccentric shaft 112 consists of three sections 112*a*, 112*b*, and 112c. One end of section 112a of the eccentric shaft 112 is positioned in bearing 100a in bottom wall 74f of the gear box 74. A planetary gear 72a is coupled to section 112a of the eccentric shaft 112 so that when energy is imparted to the sun gear 70, said energy is transferred to gear 72a and in turn to shaft 112 thereby causing shaft 112 to rotate. The rotation of the shaft section 112a is concentric within the bearings 100 and 100a. An oil seal 114 is positioned coaxial with and adjacent to bearing 100 to seal aperture 94. A second eccentric shaft 116 consists of three sections 116a, 116b, and 116c. The bearings 102 and 102a are coaxial. One end of section 116a of the eccentric shaft 116 is positioned in bearing 102a; bearing 102a being positioned in bearing recess 108 of wall 74f of the gear box 74. The section 116a of the eccentric shaft 116 is coupled to a planetary gear 72b so that when energy is imparted to the sun gear 70, said energy is transferred to the gear 72b and in turn to the eccentric shaft 116. The rotation of section 116a of the eccentric shaft 116 is concentric within bearings 102 and 102a. An oil seal 118 is positioned coaxial with and adjacent to bearing 102 to seal aperture 96 in top wall 74e of the gear box 74.

Likewise, a third eccentric shaft 120 consisting of three sections 120a, 120b, and 120c is positioned coaxial with and through bearings 104 and 104a. One end of section 120a of the eccentric shaft 120 is positioned in bearing 104a; bearing 104a being positioned in bearing recess 110 of the bottom wall 74f of the gear box 74. The sections 120a of the eccentric shaft 120 is coupled to a planetary gear 72c so that when energy is imparted to the sun gear 70, said energy is transferred to the gear 72c and in turn to the eccentric shaft 120. The rotation of section 120a of the eccentric shaft 120 is concentric within the bearings 104 and 104a. An oil seal 122 is positioned coaxial with and adjacent to bearing 104 to seal aperture 98 in top wall 74e of the gear box 74. FIG. 11 illustrates a longitudinal view of a typical eccentric shaft exemplified by the shafts 112, 116 and 120.

The oil seals 114, 118, and 122 are press fit into bearing retainers 123a, 123b, and 123c which in turn are fixed to the top wall 74e of the gear box 74 by bolts 124 or other means well known in the art. In operation, the drive shaft 78 receives energy from the motor 92 via the drive belt 90. The energy imparted via the drive belt 90 rotates shaft 78 within bearings 84 and 80 and imparts rotary motion to the sun gear 70. The sun gear 70 is matingly coupled to the planetary gears 72a, 72b, and 72c enabling said gears to rotate simultaneously with the sun gear 70. Rotary motion is imparted to eccentric shafts 112, 116, and 120 by means of the planetary gears 72a, 72b, and 72c to which they are respectively coupled, when the sun gear 70 is rotating. The oil seals 86, 114, 118, and 122 enable the oil, not illustrated, to be sealed within the gear box 74.

The center sections of the eccentric shafts 112b, 116b, and 120b rotate eccentrically as the shafts 112, 116, and 120 are rotated respectively by the planetary gears 72a, 72b, and 72c. The rotary plate 60 has three shaft apertures 126a, 126b, and 126c spaced eqiangular and equidistant from each other and are of a diameter sufficient to enable the passage therethrough of shafts 112, 116, and 120 respectively, via bearing pairs 128, 128a; 130, 130a; and 132, 132a. Each of the pair of bearings 128, 128a; 130, 130a; and 132, 132a are preloaded and press fit together on opposite ends of the respective apertures 126a, 126b, 126c by bearing retaining means 129, 129b, and 129c. A plurality of bolts 131 secures each of the bearing retainer means 129a, 129b, and 129c to the plate 60. It is necessary that the eccentric portion of each shaft 112, 116, and 120 extend between each bearing pair 128, 128a; 130, 130a; and 132, 132a. Bearing retaining means are well known in art and are readily available in the market place.

A shaft support place 134 illustrated in FIG. 17 having three apertures 136a, 136b, and 136c is positioned so as to enable the passage of shaft sections 112c, 116c, and 120c therethrough via bearings 138a, 138b, and 138c; said bearings being press fit into said apertures. The position of the shafts 112, 116, and 120 is such that they form an equilateral triangle. A bearing retainer 135a, 135b, and 135c secures bearings 138a, 138b, and 138c respectively to the plate 134 by means well known in the art. A bearing support column 137 is positioned between the upper plate 74f of the gear box 74 and and the shaft support plate 134 and secured thereto by means well known in the art; said column passing through an aperture 139 in the rotary motion plate 60. The shaft sections 112c, 116c, and 120c rotate concentrically within bearing 138a, 138b, and 138c respectively when the respective shafts are rotated by their respective planetary gears 72a, 72b, and 72c. It is understood that more than or less than the three shafts illustrated in the drawings may be used without departing from the spirit and scope of the invention. However, I have found that by using three eccentric shafts spaced equidistant and equiangular from each other, that I obtain a very stable rotary motion of rotary plate 60; said rotary motion being imparted by the eccentric movement of sections 112b, 116b, and 120b of the eccentric shafts 112, 116, and 120. Eccentric shafts are well known in the art and are custom made to customer's specification. The basic characteristic of said shafts is that an eccentric rotary motion is imparted to the center of the shaft while its opposite ends rotate concentrically. The shaft is designed to accommodate the gears coupled thereto and is set for a specific offset which I have found for purposes of my invention to be 1/16 of an inch. The design of the eccentric shafts with a 1/16of an inch offset creates a ⅛ of an inch eccentric motion when said shaft is rotating.

The chamber release means 62 are comprised of a plurality of gates 140 having a D-shaped configuration. The gates 140 are positioned below each chamber 50 and form the bottom side of said chamber; the product flowing into said chamber accumulating onto the gates 140. Each gate 140 has a lever arm 142, one end of which is coupled to the gate 140, the other end being coupled to a bobbin 144 by means of a bobbin spoke 146. The lever arm 142 is a round rod enabling it to be easily rotated. The bobbin 144 is coupled to an air cylinder 148 by piston 149 illustrated in FIG. 16. The plurality of lever arms 142 are rotated through a 90° arc when the bobbin is placed in a downward position by the air cylinder 148 which in turn rotates the gates 140 from a horizontal position to a vertical position. When the gates 140 are in a vertical position, the contents in the chamber supported by said gate are discharged into a discharge tube 66 as illustrated in FIG. 1. There is a gate 140 for each chamber 50 and when the bobbin 144 is activated by the air cylinder 148 all gates are simultaneously activated, turning through a 90° arc, discharging the contents of each chamber 50 into a plurality of discharge tubes 66. The gates 140 are returned to the horizontal position when the air cylinder 148 moves in the upward direction. The time lapse between air cylinder 148 moving down causing the gates to rotate from a horizontal to a vertical position and the air cylinder moving up causing the gates to return to the horizontal position is a fraction of a second. It is understood that the movement of the cylinder could be reversed, i.e.; an upward movement thereof causes the gates to move from the horizontal to the vertical position and from a downward movement causes the gates to return to the horizontal position. An electrical interlocking system, not illustrated, may be used so as to enable the gates 140 to return to their horizontal position prior to any further product being deposited into the chambers 50.

The chamber release means 62 illustrated in FIGS. 6 and 7 are positioned coaxial with and immediately below the cavity 48 within the aperture 68 of the rotary motion plate 60. The chamber release means 62 is of a circular configuration having an integral outer flange 188; said flange having a plurality of equally spaced mounting holes 190. The diameter of the chamber release means 62, exclusive of its integral flange 188, is equal to the diameter of the aperture 68 of the rotary motion plate 60 enabling the chamber release means to be press fit into said aperture. The rotary motion plate 60 has a plurality of apertures 192 equal to the number of mounting holes 190 of the flange 188. When the chamber release means 62 is press fit into the aperture 68, the mounting holes 190 are aligned with the apertures 192 so that they are coaxial. A plurality of mounting holes 194 are positioned in the flange 49a of the cavity 48, said mounting holes being equal in number and size as the mounting holes 190 and apertures 192. The mounting holes 194 are positioned around the flange 49a so that when said mounting holes are coaxial with the mounting holes 190 of the chamber release means flange 188 and the apertures 192, there is a gate 140 adjacent to and below each chamber 50 of the cavity 48. When the mounting holes 194 of the cavity 48 are coaxial with the mounting holes 190 of the chamber release means 62 and the apertures 192, a bolt 196 is positioned in each of the plurality of mounting holes. The bolt 196 has a head 198 at one end and a threaded portion at the outer end for receiving a nut 200. When the nut 200 is placed in each of the plurality of bolts 196, the cavity 48 and chamber release means 62 are secured to the rotary motion plate 60.

The air cylinder 148 has a threaded extension 201 coupled to a circular mounting plate 202 via a centrally positioned threaded aperture 203 in said plate. The mounting plate has a plurality of circumferentially positioned apertures 204 equally spaced.

The chamber release means 62 has a plurality of mounting holes 206 positioned to enable said mounting holes to be coaxial with the threaded apertures 204 of the air cylinder mounting plate 202.

The rotary motion means 58 are coupled to a timing device, not illustrated, which is electrically interlocked to the air cylinder 148 by means well known in the art. The timing device enables sufficient time for the product to be evenly distributed within the chambers 50 of the cavity 48 by means of the rotary motion means 58. When the timing device reaches its preset time, an electrical signal activates the air cylinder 148 which in turn moves the bobbin 144 in a downward direction. The electrical circuitry for interlocking the rotary motion means 58 and the air cylinder 148 is well known in the art and is not illustrated.

There are many other types of release means that can be used without departing from the spirit and scope of the invention. One of such methods, not illustrated, would be to use a single gate plate which forms a common bottom plate for all of the chambers 50. An air cylinder can be used to move the gate plate in a horizontal direction away from the chambers discharging the contents thereof and into the plurality of dischage tubes 66.

The quantity of product held by each chamber can be readily changed by means of an extender section 153 which can be easily added or subtracted from the cavity. The extender section 153 has the same geometrical configuration of the cavity 48. The extender plate 153 has a plurality of apertures 154 equal to the number of chambers 50 of the cavity 48 and having the same geometrical configuration as the lower portion of the chamber 50a; said geometric configuration being a cylinder. The extender section can be sized to equal a particular weight or volume of product and is illustrated in FIGS. 12 and 13. It is preferred that the extender section 153 be coupled to the bottom side of the cavity 48. When this is done, the chamber release means 62 is coupled to and below the extender section 153, by means well known in the art.

The discharge tubes 66 are coupled to a plurality of apertures 150 in a transition section 152 illustrated in FIGS. 8, 8a, and 8b. The product in the discharge tube 66 flows into a container 64 in position below the discharge tube, a container being positioned below each discharge tube 66.

The transition section 152 is of a circular configuration having a diameter equal to the diameter of aperture 68 of the rotary motion plate 60, enabling said transition section to be press fit into said aperture. An aperture 208 is centrally positioned to enable the air cylinder piston 149 to pass therethrough. There is a plurality of apertures 210 circumferentially positioned about aperture 208; said plurality of apertures 210 being coaxial with the threaded apertures 204 of the air cylinder mounting plate 202. When the threaded apertures 204 of the air cylinder mounting plate 202, the mounting holes 206 of the chamber release means, and the apertures 210 of the transition section 152 are coaxial with each other, a threaded bolt 212 is positioned herein securing the air cylinder mounting plate 202 to the transition section 152 and the chamber release means 62. A plurality of threaded bolts 214 secure the cone element 52 to the cavity 48.

The transition section has a plurality of outer mounting holes 216 which are coaxial with an equal plurality of outer mounting holes 218 of the chamber release means; said mounting holes being suitable for receiving a threaded bolt, not shown, securing said transition section 152 to the chamber release means 52. The transition section 152 is positioned below and coaxial with the chamber release means 62 of the cavity 48. The transition section has formed therein a plurality of irregular shaped openings 150 below each gate 140 that enables each gate 140 to be opened or positioned vertically against said opening. The discharge tubes 66 are coupled to the lower end of the openings 150. The opposite ends of the discharge tubes 66 are positioned in a receiving plate 187 for distributing the product into containers 64. The discharge tube and container configuration illustrated in FIG. 1 is square having nine containers. However, it is understood that any type of configuration can be used, be it linear, circular, or of any other geometrical shape. The confiuration of said discharge tubes 66 and thus the containers 64 can be variable without departing from the spirit and scope of the invention.

The weigh bucket release means 46, as illustrated in figures 15 and 18 are coupled to and are integral with the lower end 44 of the weight bucket 40. The bucket release means 46 comprises a cone shaped element 156 coupled to the bucket 40 by means of a plurality of hinge means 158. The lower circumference of the cone element 156 matingly engages the lower end 44 of the bucket 40 when the cone 156 is in its normal or closed position thereby holding product within the bucket 40.

The hinge means are comprised of a pair of arms 159, 159*a*. One end of each of the arms 159, 159*a* is respectively connected to hinge elements 160, 160*a;* the other end of said arms being respectively coupled to a wheel element 161, 161*a*. The hinge means 158 are coupled to the bucket 40 by a U-shaped support member 162; said support member having a slot 163, 163*a* to enable the passage therethrough and vertical movement therein of arms 159, 159*a*. Arm support members 164, 164*a* are connected between the support bracket 162 and the arms 159, 159*a*.

The cone element 156 has an apex 165 which is coupled to the hinge elements 160, 160*a* by a rod 166 through a fixed guide bushing 167. A spring element 168, 168*a*, is respectively coupled to arms 159, 159*a* the the bucket 40; the springs maintaining a positive tension on the arms 159, 159*a* and insuring firm contact of the lower circumference of the cone element 156 with the lower end 44 of the bucket 40. When the bucket release means 46 is in its closed position, the springs 168, 168*a* maintain the arms 159, 159*a* against the lower end of slots 163, 163*a* respectively. When the arms 159, 159*a* are moved in an upward position within slots 163, 163*a* the rod 166 is moved downward, disengaging the cone element 156 from the lower end 44 of the bucket 40, enabling the product within said bucket to pass into the cavity 48. An air cylinder 169 via connecting linkage 171, 171*a* enables the arms 159, 159*a* to move in an upward direction, said linkage engaging both of the wheel elements 161, 161*a* when said air cylinder is actuated.

The hinge means 158 are actuated by the air cylinder 169 that is responsive to electrical signals from the weigh cell 34. As stated hereinbefore, when the weight in the bucket 40 equals the referenced weight/voltage of the weigh cell 34, an electrical signal turns the electromagnetic feeders 30 and 32 off stopping the flow of product into the bucket 40. Simultaneously with the stopping of the flow of product into the bucket 40, the air cylinder 160 is actuated which moves the cone element 156 in a downward direction enabling the product within the bucket 40 to be distributed around the circumference of the cavity 48 and into the chambers 50 and head space 56.

A time delay in the control circuits between the weigh cell 34, air cylinder 169 and electromagnetic feeders 30 and 32 allows sufficient time for emptying the contents of the bucket 40 into the chambers 50 and upon expiration of said time delay the air cylinder 169 is released enabling the bottom of the cone 156 to come into engagement with the bottom of the bucket 40. When the cone element 156 is in its normal or closed position the electromagnetic feeders are once again activated and product flows into the bucket 40. The time delay and control circuitry for stopping the flow of product into the weigh bucket, discharging it into the cavity and closing the bucket release means prior to starting the flow of product into the bucket 40 is well known in the art and is not illustrated.

The weigh bucket release means 46 described hereinabove is one of many means for discharging the contents of the bucket 40 into the cavity 48 and its chambers 50. Another one of the many means for discharging the product in bucket 40 into the chambers 50 of the cavity 48 is to use a pair of hinged gates, not shown, to form the bottom of the bucket 40 and have said gates open and close by means of a solenoid, not illustrated. There are many other types of release means that are well known in the art that can be incorporated into the bucket 40 without departing from the spirit and scope of the invention.

The feeder base member 22 is adjustable in a vertical direction by means of a pair of screws 170 positioned opposite one another. The feeder base member 22 has four apertures 172*a*, 172*b*, 172*c*, and 172*d* positioned relative to one another to enable the passage therethrough of vertical frame columns 24*a*, 24*b*, 24*c*, and 24*d*, respectively, thereby enabling the vertical movement of the feeder base member 22 along said vertical frame columns.

The pair of screws 170 positioned opposite one another and between vertical columns 24*a*, 24*b;* and 24*c*, 24*d* respectively are positioned through apertures 174 in the feeder base member 22. The screws 170 have threads of a size sufficient to hold the feeder base 22 and all of the elements coupled thereto. A sprocket drive 176 is coupled to each of the screws 170 and is secured thereto by a threaded nut 178; the threaded nut being attached to the sprocket 176. A drive chain 180, suitable for engagement with the sprocket 176 extends between and engages the sprockets 176 on each of the screws 170. The threaded nut 178 is compatible with the threaded screws 170 so as to enable the engagement of the nut in the screw. A plurality of bolts 182 secures the feeder base to the columns 24*a* through 24*a*. To adjust the vertical height of the feeder base 22, the bolts 182 are loosened and one of the nuts 178 is rotated for the vertical movement desired. The rotation of the nut 178 rotates the sprocket 176 which in turn imparts motion to the chain 180 that turns the opposite sprocket 176 and its attached nut 178, moving the feeder base 22 equally upon the screws 170 as illustrated in FIG. 44.

The vertical movement of the feeder base 22 along the columns 24*a*, 24*b*, 24*c*, and 24*d* enables the weigh cell 34 and the weigh bucket 40 coupled thereto to be vertically adjusted relative to the cavity 48 as well as the conveyor means 18 and the hopper 12 if it is coupled to said feeder base. The ability to raise the weigh bucket 40 above the cavity 48 enables the extender section 153 to be added below the cavity 48 increasing the quantity of product held by the chambers 50 of the cavity 48.

The rotary motion means 58 are coupled to the columns 24*a*, 24*b*, 24*c*, and 24*d* by means well known in the art. There are many ways in which to couple said rotary motion means to said vertical columns and any of such means can be used without deviating from the spirit and scope of the invention. The columns 24*a*, 24*b*, 24*c*, and 24*d* are coupled to a frame base 184 and a frame cap 186. The motor 92 is coupled to the rotary motion 58 and to the apparatus 10 by means well known in the art.

In operation, a product is introduced into the hopper 12. The product flows through the chute or passageway 17 to the rear feeder pan 26. The product is conveyed along the rear feeder pan 26 by means of the electromagnetic feeder 30 to the front feeder pan 28 and enters said front feeder pan by means of gravity. The product is next conveyed to the weigh bucket 40 by means of the front feeder pan 28 and its associated electromagnetic feeder 32 and enters said weigh bucket by means of gravity. The electromagnetic feeders 30 and 32 are electrically operated, electrical connections and source not being illustrated. However, the turning on and off of said electromagnetic feeders is achieved by means of control circuitry, not illustrated, between said electromagnetic feeders, the weigh cell 34 and the weigh bucket release means 46.

The product accumulates in the weigh bucket 40 until a preset weight is reached. When the preset weight is reached, as determined by the weigh cell 34, an electrical control signal is transmitted via control circuitry, not shown, to the electromagnetic feeders 30 and 32 that stops them, and simultaneously to the weigh bucket release means 46 which in turn activates air cylinder 169 lowering the cone element 156 thereby enabling the product within the weigh bucket 40 to be evenly distributed, circumferentially, in the chambers 50 and head space 56 of the cavity 48.

The hopper 12, electromagnetic feeders 30 and 32, weigh cell 34 and the weigh bucket 40 are elements readily available in the market place and all of which are coupled together to the feeder base 22. The feeder base 22 is vertically adjustable via screws 170 and the sprocket and nut 176, 178. The coupling of the hopper 12, feeder pans 26, 28 and their associated electromagnetic feeders 30, 32, the weigh cell 34 and weigh bucket 40 are by means well known in the art. I prefer to use steel stock for the feeder base and for the structure coupling the hopper, the convyor means, and the weigh cell to said feeder base because of its strength and availability. However, it is understood that other materials may be used without deviating from the spirit and scope of this invention.

The feeder base 22 is positioned to enable the bucket 40 to be slightly within the cavity 48 as illustrated in FIG. 2. It is not necessary that this be; however, I have found that by so doing a more accurate distribution of the product is achieved.

The rotary motion means 58 are attached to the apparatus 10 by means well known in the art and are coupled to the vertical columns 24*a* through 24*d*. The positioning of the three eccentric shafts 112, 116 and 120 equiangular and equidistant from one another creates within the rotary motion plate 60 a rotary motion; the plate 60 being coupled to the eccentric sections 112*b*, 116*b*, and 120*b* of said shafts. The cavity is directly coupled to the plate 60 and the rotary motion of plate 60 is transferred to the cavity 48. The rotary motion of the cavity 48 creates a centrifugal force within each chamber 50 in a direction as indicated by the arrows in FIG. 3. The centrifugal forces created within each chamber 50 will seek to equalize the pressure adjacent each side of contiguous chambers; thereby enabling a chamber having more product than its adjacent chambers to sluff-off the additional product from the chamber containing more product to its adjacent chamber containing less product. The equalizing of product within the chamber 50 as well as in the head space 56 is accomplished by meanns of the rotary motion means 58, the plate 60, and the centrifugal forces set up within the chambers 50 of the cavity 48 by said rotary motion means and plate.

As stated hereinfore, the product within each of the chambers 50 is held therein by the gates 140 of the chamber release means 62; there being a gate for each chamber. The gates 140 are opened, enabling the product to leave the chamber when the air cylinder 148 is activated. The air cylinder 148 is activated by an electrical signal when the time delay for the rotary motion means has been completed. The time delay mechanism, not illustrated, is a standard device readily obtainable in the market place. The time delay mechanism enables the product within the cavity 48 to be evenly divided into the chambers 50 via the centrifugal forces created within said cavity by the rotary motion means 58. The air cylinder 148, when activated, moves the piston 150 and the bobbin 144 coupled thereto in an upward direction. The upward movement of the bobbin causes lever arms 142 via the spoke 146 to rotate 90° which in turn rotates the gates 140 connected thereto 90° from a horizontal to a vertical position. All of the gates 140 are rotated simultaneously when the air cylinder 148 is activated.

The transition section 152 is positioned coaxial with and below the chamber release means 62 so that there is an aperture 150 opposite and below each of the gates 140. When the gate 140 is rotated 90° to a vertical downward position, the gate is positioned against the aperture 150 enabling the product within the chamber to fall unimpaired into the discharge tube 66 and then to the container 64. There is a discharge tube 66 for each chamber; said tube being directly coupled to the aperture 150.

There is a container 64 positioned directly under each of the discharge tubes 66. When the containers 64 are filled with product, the filled containers are moved out of position from under the discharge tubes and a new set of containers are moved into position under the discharge tubes by means well known in the art.

It is believed that the invention has been described in such detail as to enable those skilled in the art to understand the same, and it will be appreciated that variations may be made without departing from the spirit and scope of the invention.

What is desired to secure by letters patent in the United States is:

1. An improved net weight filler for simultaneously filling a plurality of containers with a product, comprising:

a plurality of vertical support columns;

a weigh bucket;

weight measuring means coupled to said weigh bucket;

means for supporting said weigh bucket and weigh measuring means and for coupling same to said support columns;

a cavity having a plurality of chambers for receiving product from the weigh bucket and positioned relative to said weigh bucket to enable the product to flow from the weigh bucket into the cavity;

rotary motion means for accurately and efficiently distributing equal quantities of product volumetrically into each of said plurality of chambers by sluffing-off product from a chamber having more product to an adjacent chamber having less product; said cavity being coupled to the rotary motion means and said rotary motion means being coupled to the plurality of vertical support columns; and chamber release means coupled to and below the cavity for releasing the product within each chamber into the plurality of containers; and wherein the sluffing-off of product from a chamber having more product to an adjacent chamber having less product is achieved by the rotary motion means creating an equal circumferential pressure in each of the plurality of chambers.

2. An improved net weight filler as defined in claim 1 wherein said filler further comprises:

a transition section coupled to and below the chamber release means.

3. An improved net weight filler as defined in claim 2 wherein said filler further comprises:

a plurality of discharge tubes having one end coupled to the transition section and its opposite end positioned adjacent to and over the plurality of containers.

4. An improved net weight filler as defined in claim 3 wherein said filler further comprises:

weigh bucket release means coupled to the weigh bucket.

5. An improved net weight filler as defined in claim 4 wherein said filler further comprises:

a filler hopper;

conveyor means for conveying the product from said hopper the the weigh bucket; said conveyor having one end positioned adjacent to and above the weigh bucket and the other end adjacent to and below the hopper; and a feeder base member having coupled thereto the filler hopper and the conveyor means wherein said feeder base member is coupled to the vertical support columns.

6. An improved net weight filler as defined in claim 5 further comprising:

means for moving said feeder base member vertically on said columns.

7. An improved net weight filler as defined in claim 6 wherein said means for supporting the weigh bucket and weigh measuring means comprises a support bracket, said support bracket having one end coupled to the feeder base member and its other end to the weigh measuring means.

8. An improved net weight filler as defined in claim 7 wherein said weigh measuring means is a weigh cell.

9. An improved net weight filler as defined in claim 8 further comprising:

a rotary motion plate coupled to the rotary motion means and the cavity, wherein said rotary motion plate enables the rotary motion means to create centrifugal forces within each of the chambers of the cavity, equalizing the product in each chamber.

10. An improved net weight filler as defined in claim 9 wherein said rotary motion means comprises:

a gear box having a sun gear and a plurality of planetary gears, said gears being positioned relative to one another to enable imparting of motion to the planetary gears upon motion being imparted to the sun gear.

11. An improved net weight filler as defined in claim 10 wherein said rotary motion means further comprises:

an eccentric shaft coupled to each of the plurality of planetary gears and to the rotary motion plate;

a drive shaft coupled to the sun gear; and means for imparting motion to said drive shaft.

12. An improved net weight filler as defined in claim 11 wherein said eccentric shaft comprises:

three sections, the center section rotating eccentrically while the end sections rotate concentrically, wherein the eccentric section of each of the plurality of eccentric shafts are coupled to the rotary motion plate creating an eccentric motion of the rotary motion plate upon movement of the planetary gears.

13. An improved net weight filler as defined in claim 12 wherein said rotary motion plate has an aperture therein for receiving the cavity.

14. An improved net weight filler as defined in claim 13 wherein the means for imparting motion to the drive shaft is a motor.

15. An improved net weight filler as defined in claim 14 wherein said chamber release means comprises:

a plurality of gates positioned adjacent to and below said chambers;

a bobbin;

a plurality of lever arms coupling the bobbin to each of the plurality of gates.

16. An improved net weight filler as defined in claim 15 wherein said chamber release means further comprises:

an air cylinder coupled to said bobbin enabling said bobbin to be moved in a vertical direction when it is activated; wherein the movement of the bobbin turns the lever arms and the gates coupled thereto; said gates being moved from a horizontal to a vertical position, and upon movement of the bobbin to its original position by the air cylinder, the gates are returned to the horizontal position.

17. An improved net weight filler as defined in claim 16 wherein said weigh bucket release means comprises:

a U-shaped bracket coupled to the weigh bucket;

a cone shaped element positioned within said weigh bucket so that the base of the cone matingly engages the lower end of the bucket;

hinge means coupled to said bracket;

a rod positioned between and coupled to the cone element and the hinge means; and an air cylinder coupled to the hinge means, wherein activation of the air cylinder enables the base of the cone to be disengaged from the lower end of the bucket; the product within said bucket being dispersed into the plurality of chambers of the cavity.

18. An improved net weight filler as defined in claim 17 wherein said hinge means comprises:

a pair of arms coupled to the bracket and to the rod;

a pair of wheel elements coupled to said arms; and a pair of spring elements positioned between and coupled to the arms and the weigh bucket, wherein said spring elements maintain a positive pressure upon the cone element to the lower end of the weigh bucket.

19. An improved net weight filler as defined in claim 18 wherein said transition section has a plurality of irregular shaped apertures, said apertures being positioned adjacent to and below said gates; and, said apertures being suitable for receiving the gates of the chamber release means enabling the uninhibited flow of product from the chamber through the gate and transition section to the containers.

20. An improvednet weight filler as defined in claim 19 wherein said cavity further comprises:

a cone element coaxial with said cavity;

a wall circumferentially positioned and coaxial with said cavity;

a plurality of radial sides positioned between the cone element and the circumferential wall, said radial sides defining the plurality of chambers.

21. An improved net weight filler as defined in claim 20 wherein said conveyor means comprises:

a rear product feeder coupled to the feeder base member and positioned relative to the hopper to receive product therefrom; and a front product feeder coupled to the feeder base member and having one end thereof positioned adjacent to and below the rear product feeder and the other end adjacent to and above the weight bucket enabling product to flow from the rear product feeder to the front feeder and into the weight bucket.

22. An improved net weight filler as defined in claim 21 wherein said conveyor means further comprises:

an electromagnetic feeder coupled to the rear product feeder; and an electromagnetic feeder coupled to the front product feeder, wherein said electromagnetic feeders create vibrations in their respective product feeders causing the product within said product feeders to be conveyed into the weigh bucket.

23. An improved net weight filler as defined in claim 22 wherein said means for moving the feeder base member comprises:

a pair of screws positioned opposite one another and passing through the feeder base member;

a sprocket drive coupled to each screw having a sprocket chain coupled thereto; and a nut coupled to each screw and to the sprocket drive wherein the rotation of the nut on either of the pair of screws will also turn the nut on the opposite screw and move the feeder base member vertically upon the vertical columns.

24. An improved net weight filler for simultaneously filling a plurality of containers with a product, comprising;

a plurality of vertical columns;

a feeder base member coupled to the plurality of vertical columns and movable thereon;

a filler hopper coupled to said feeder base;

conveyor means coupled to said feeder base and positioned to receive product from the hopper;

weigh measuring means coupled to said feeder base member;

a weight bucket coupled to the weigh measuring means;

weigh bucket release means coupled to the weigh bucket;

rotary motion means coupled to the plurality of vertical columns;

a rotary motion plate coupled to the rotary motion means;

a cavity coupled to the rotary motion plate and positioned adjacent to and below the weigh bucket, said cavity having a plurality of chambers for receiving product from the weigh bucket;

chamber release means positioned coaxial with and adjacent to and below the cavity;

a transition section positioned coaxial with and adjacent to the chamber release means, enabling product to flow from the chambers through the chamber release means and transition section to the plurality of containers; and wherein the product is evenly distributed by volume into each of the plurality of chambers by the rotary motion means creating equal circumferential pressures in each chamber that causes a chamber having more product than its adjacent chamber to sluff-off product from the chamber having more product to the adjacent chamber having less product.

25. An improved net weight filler as defined in claim 24 wherein said conveyor means comprises:

a rear product feeder coupled to the feeder base member and positioned relative to the hopper to receive product therefrom; and a front product feeder coupled to the feeder base member and having one end thereof positioned adjacent to and below the rear product feeder and the other end adjacent to and above the weight bucket enabling product to flow from the rear product feeder to the front product feeder and into the weigh bucket.

26. An improved net weight filler as defined in claim 25 wherein said conveyor means further comprises:

an electromagnetic feeder coupled to the rear product feeder; and an electromagnetic feeder coupled to the front product feeder, wherein said electromagnetic feeders create vibrations in their respective product feeders causing the product within said product feeders to be conveyed into the weight bucket.

27. An improved net weight filler as defined in claim 26 wherein said weigh measuring means is a weight cell.

28. An improved net weight filler as defined in claim 27 wherein said bucket release means comprises:

a U-shaped bracket coupled to the weight bucket;

a cone shaped element positioned within said weigh bucket so that the base of the cone matingly engages the lower end of the bucket;

hinge means coupled to said bracket;

a rod positioned between and coupled to the cone element and the hinge means; and an air cylinder coupled to the hinge means, wherein activation of the air cylinder enables the base of the cone to be disengaged from the lower end of the bucket; the product within said bucket being dispersed into the plurality of chambers of the cavity.

29. An improved net weight filler as defined in claim 28 wherein said hinge means comprises:

a pair of arms coupled to the bracket and to the rod;

a pair of wheel elements coupled to said arms; and a pair of spring elements positioned between and coupled to the arms and the weight bucket, wherein said spring elements maintain a positive pressure upon the cone element to the lower end of the weigh bucket.

30. An improved net weight filler as defined in claim 29 wherein said rotary motion means comprises:

a gear box having a sun gear and a plurality of planetary gears, said gearss being positioned relative to one another to enable imparting of motion to the planetary gears upon motion being imparted to the sun gear.

31. An improved net weight filler as defined in claim 30 wherein said rotary motion means further comprises:

an eccentric shaft coupled to each of the plurality of planetary gears and to the rotary motion plate;

a drive shaft coupled to the sun gear; and means for imparting motion to said drive shaft.

32. An improved net weight filler as defined in claim 31 wherein the eccentric shaft comprises:

three sections, the center section rotating eccentrically while the end sections rotate concentrically, wherein the eccentric section of each of the plurality of eccentric shafts are coupled to the rotary motion plate creating an eccentric motion of the rotary motion plate upon movement of the planetary gears.

33. An improved net weight filler as defined in claim 32 wherein said cavity further comprises:

a cone element coaxial with said cavity;

a wall circumfernentially positioned and coaxial with said cavity;

a plurality of radial sides positioned between the cone element and the circumferential wall, said radial sides defining the plurality of chambers.

34. An improved net weight filler as defined in claim 33 wherein said chamber release means comprises:

a plurality of gates positioned adjacent to and below said chambers;

a bobbin;

a plurality of lever arms coupling the bobbin to each of the plurality of gates.

35. An improved net weight filler as defined in claim 34 wherein said chamber release means further comprises:

an air cylinder coupled to said bobbin enabling said bobbin to be moved in a vertical direction when it is activated; wherein the movement of the bobbin turns the lever arms and the gates coupled thereto; said gates being moved from a horizontal to a vertical position, and upon movement of the bobbin to its original position by the air cylinder, the gates are returned to the horizontal position.

36. An improved net weight filler as defined in claim 35 wherein said transition section has a plurality of irregular shaped apertures, said apertures being positioned adjacent to and below said gates; and, said apertures being suitable for receiving the gates of the chamber release means enabling the uninhibited flow of product from the chamber through the gate and transition section to the containers.

37. An improved net weight filler as defined in claim 36 wherein said filler further comprises:

a plurality of discharge tubes having one end coupled to the transition section and its opposite end positioned adjacent to and over the plurality of containers.

* * * * *

UNITED STATES PATENT OFFICE

CERTIFICATE OF CORRECTION

Patent No. 3,995,668 Dated December 7, 1976

Inventor(s) James A. Goodman

It is certified that error appears in the above-identified patent and that said Letters Patent are hereby corrected as shown below:

Column 4, line 21, delete "and", second occurrence.

Column 8, line 18, delete "and", second occurrence.

Column 14, line 69, delete "; and" after "vertical support columns".

Signed and Sealed this

Twenty-second Day of March 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,995,668 Dated December 7, 1976

Inventor(s) James A. Goodman

It is certified that error appears in the above-identified patent and that said Letters Patent are hereby corrected as shown below:

Col. 2, line 47, "relese" should read -- release --.

Col. 3, line 26, "of" first occurrence, should read -- or --.

Col. 5, line 14, "bucket 40" should read -- weigh bucket 40 --.

Col. 6, line 12, "chamber release 62" should read -- chamber release means 62 --.

Col. 6, line 40, after "botom side 74e and 74f" -- respectively. An aperture 76 is positioned within bottom side 74f -- should be inserted.

Col. 7, line 31, "sections" should read -- section --.

Col. 8, line 1, "129" should read -- 129a --.

Col. 11, line 7, "weight" should read -- weigh --.

Col. 11, line 29, "the" first occurrence should read -- and --.

Col. 12, line 41, "24a" should read -- 24d --.

Col. 12, line 48, "figure 44" should read -- figure 14 --.

Col. 12, line 67, "motion 58" should read -- motion means 58 --.

Col. 13, line 64, "chambers" should read -- chamber --

Col. 13, line 68, "meanns" should read -- means --.

Col. 14, line 4, "hereinfore" should read -- hereinbefore --.

Col. 14, line 52, "weight" should read -- weigh --.

Col. 15, line 27, after "hopper" "the" should read -- to --.

Col. 16, line 64, "improvednet" should read -- improved net --.

UNITED STATES PATENT OFFICE

CERTIFICATE OF CORRECTION

Patent No. 3,995,668 Dated December 7, 1976

Inventor(s) James A. Goodman Page 2 of 2

It is certified that error appears in the above-identified patent and that said Letters Patent are hereby corrected as shown below:

Col. 17, line 12, "weight" should read -- weigh --.

Col. 17, line 14, "front feeder" should read -- front product feeder --.

Col. 17, line 15, "weight" should read -- weigh --.

Col. 17, line 39, ";" should read -- : --.

Col. 17, line 48, "weight" should read -- weigh --.

Col. 18, line 15, "weight" should read -- weigh --.

Col. 18, line 27, "weight" should read -- weigh --.

Col. 18, line 29, "weight" should read -- weigh --

Col. 18, line 33, "weight" should read -- weigh --.

Col. 18, line 50, "weight" should read -- weigh --

Col. 18, line 56, "gearss" should read -- gears --.

Col. 19, line 11, "circumfernentially" should read -- circumferentially --.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*